US006749411B1

(12) United States Patent
Lee

(10) Patent No.: US 6,749,411 B1
(45) Date of Patent: Jun. 15, 2004

(54) ROTARY VANE HYDRAULIC POWER DEVICE

(76) Inventor: Charles Matthew Lee, 837 Spence Cir., Virginia Beach, VA (US) 23462

( * ) Notice: Subject to any disclaimer, the term of this patent is extended or adjusted under 35 U.S.C. 154(b) by 0 days.

(21) Appl. No.: 10/440,879

(22) Filed: May 20, 2003

(51) Int. Cl.[7] ..... F01C 1/344

(52) U.S. Cl. ..... 417/542; 417/540; 418/132; 418/135; 418/147; 418/235; 418/256

(58) Field of Search ..... 417/540, 542; 418/132, 135, 147, 157, 235, 256

(56) References Cited

U.S. PATENT DOCUMENTS

| | | | | | |
|---|---|---|---|---|---|
| 1,249,806 | A | * | 12/1917 | Morris | 418/235 |
| 2,044,873 | A | * | 6/1936 | Beust | 418/132 |
| 3,360,192 | A | * | 12/1967 | Hees | 418/256 |
| 3,452,725 | A | * | 7/1969 | Kelly | 418/147 |
| 4,917,584 | A | * | 4/1990 | Sakamaki et al. | 418/256 |
| 5,354,187 | A | * | 10/1994 | Holland et al. | 417/540 |
| 6,599,113 | B1 | * | 7/2003 | Lee | 418/135 |

FOREIGN PATENT DOCUMENTS

| | | | | |
|---|---|---|---|---|
| CH | 209718 | * | 7/1940 | 418/235 |
| DE | 4120757 | * | 1/1992 | 417/540 |
| GB | 617705 | * | 2/1949 | 418/135 |

* cited by examiner

*Primary Examiner*—John J. Vrablik

(57) ABSTRACT

A rotary vane device for hydraulic transmission of mechanical energy with industrial scale measures of power and rotational velocity. The device offers high measures of both volumetric efficiency and rotational velocity and hence substantial measures of functional excellence in terms of power density and functional efficiency. Additionally the device functions without the use of reciprocating primary components and for this reason potentially offers substantial measures of excellence in terms of enhanced operational reliability and relatively low measures of radiated mechanical noise and vibration.

1 Claim, 14 Drawing Sheets

ROTARY VANE HYDRAULIC POWER DEVICE

BACKGROUND OF THE INVENTION

For certain power distribution applications transmission of mechanical energy by hydraulic manipulation is preferable to other options for reasons of power density, arrangement flexibility, and controllability. At the present time, machines employed for the hydraulic transmission of mechanical energy primarily consist of hydraulic pumps and hydraulic motors employing reciprocating mechanical motion of pistons and valves to accomplish movement of pressurized working fluid. Due to reciprocation of primary function components the working fluid flow inherently involves the presence of pressure fluctuations and hence inherently feature the potential for propagation of undesirable noise and mechanical vibration. Hydraulic power systems featuring relatively high measures of working fluid pressure and relatively low measures of working fluid flow velocity are often identified as "hydrostatic" power systems.

Over a number of years significant inventive effort has been directed toward the derivation of a "rotary" fluid displacement machine employing only rotationally dynamic mechanical components for working fluid manipulation. In comparison with reciprocating machines the rotary machine is perceived to offer advantages in terms of mechanical simplification and elimination of fluid flow pressure fluctuations. The radial vane type rotary machine has been the subject of particular attention in this regard.

Conceptually the rotary vane machine features a stationary hollow containment structure consisting of a containment cylinder with a precisely or approximately circular bore and with an end closure structure installed at each axial end. Said containment structure is fitted with ports for induction and discharge of working fluid through the structural boundary. A rotational armature approximately circular in cross-section and concentrically secured on a rotational shaft is installed within the bore of said containment cylinder. The diameter of said rotational armature is proportioned to create an annular cavity between the peripheral surface of said rotational armature and the bore of said containment cylinder. Said rotational shaft axially extends through the axial length of said containment structure and is radially constrained by rotational bearings. Axial ends of said rotational shaft are configured as necessary to interface with external rotational power systems. Said rotational shaft is aligned with its rotational axis parallel to but radially separated from the bore axis of said containment cylinder. Said rotational armature accommodates an axially aligned radial vane slot at each of several centers equally spaced around its periphery and said radial vane slot is proportioned to accommodate and provide sliding support for one radial vane. Said radial vane is axially proportioned to extend through the axial length of said rotational armature and radially proportioned to extend from within said radial vane slot to interface with the bore of said containment cylinder. Collectively the radial vanes subdivide said annular cavity into a number of annular segmental chambers. Since the rotational axis of said rotational shaft is radially separated from the bore axis of said containment cylinder the volume of each annular segmental chamber is dependent upon its rotational position and is cyclically manipulated upon rotation of said rotational armature. The cyclical relationship between annular segmental chamber volume and rotation of said rotational armature equates to the cyclical relationship between contained volume and piston movement featured in reciprocating type fluid displacement machines.

A number of patents have been awarded for rotary vane hydraulic power machine concepts however as of this writing none of the concepts presented in prior art are known to have matured sufficiently to demonstrate adequacy regarding one or more practical functional viability parameters. Functional viability of energy transmission machines is measured by their capability to meet thresholds for efficiency and power density within constraints imposed by natural physical phenomena.

The efficiency and power density of hydraulic rotational power machines are directly influenced by machine capabilities defined in terms of volume cycle efficiency, pressure cycle efficiency, mechanical efficiency, working fluid pressure amplification, and rotational velocity.

For rotary vane type machines volume cycle efficiency is directly related to the proportional relationship between the internal bore diameter of the containment structure and the diameter of the internal rotational armature. Pressure cycle efficiency is directly influenced by both the number of segmental chambers surrounding said rotational armature and the distance separating the rotational axis of said rotational armature from the bore axis of said containment structure. Pressure cycle efficiency is inversely influenced the relative thickness of the radial vanes and by hydrodynamic impedance imposed on the movement of working fluid as required to accomplish the cyclical manipulation.

Analysis demonstrates that the threshold for adequate pressure cycle efficiency is attained only when the number of segmental chambers surrounding said rotational armature exceeds a certain minimum value. However the radial vanes are, collectively, a potentially significant cause of degradation in mechanical efficiency due to frictional resistance at sliding interfaces. Additionally the radial vanes are, collectively, a potentially significant cause of degradation in mechanical efficiency if ancillary pumping of working fluid is incurred by reciprocating motion of the radial vane within the radial vane slot. For these reasons functional viability is dependent upon derivation the optimum balance between several efficiency considerations.

In addition to the efficiency considerations discussed above, power density is directly influenced the magnitude of working fluid pressure amplification, and the magnitude of rotational velocity. However hydraulic machines function by manipulation of an essentially non-compressible working fluid and so entail the possible occurrence of noise, vibration, and efficiency degradation due to high-pressure hydrodynamic impacting and low-pressure hydrodynamic cavitation. For these reasons acceptable limits for working fluid pressure amplification and rotational velocity and technical approaches for avoidance of hydrodynamic impacting and hydrodynamic cavitation phenomena are also functional viability considerations.

The principal features of several rotary vane type hydraulic machines presented in prior patent disclosures are reviewed below.

U.K. Pat. No. 114,584, U.K. Pat. No. 577,569, and Japan Pat. No. 63-9685 each discloses a rotary vane pump device featuring a stationary housing with an end closure structure installed at each axial end and with fluid transfer ports. Within said stationary housing a rotor is concentrically secured to a rotational shaft. Said rotational shaft is radially and axially constrained by rotational bearings installed in said end closure structure. Said rotor is fitted with an axially aligned radial vane slot at each of several centers uniformly distributed around its periphery. Each said rotor slot annularly constrains one radial vane but permits relative sliding motion in a radial direction. Said radial vane is radially constrained at each axial end by a rotating ring configured as an axially extended peripheral flange on a rotating disk. Said rotating ring is proportioned to maintain a constant distance between the outer peripheral edge of said radial vane and the bore of said stationary housing. Centripetal load induced by said radial vane due to rotor rotation is imposed on the said rotating ring by direct edge contact of said radial vane. Said rotating disk is radially and axially constrained by a low friction rotational bearing. The rotational axis of said rotating disk is aligned to be concentric with the longitudinal axis of the bore of said stationary housing. Said rotating disk maintains contact with the axial end of each said radial vane and with the axial end of said rotating armature.

All disclosures identified above present the primary mechanical features required for manipulation of hydraulic fluids and substantially focus on technical approaches toward minimization of friction particularly as related to radial vanes. However all disclosures identified above are essentially silent regarding other mechanical considerations inherently related to the functional viability of rotary vane hydraulic power devices.

BRIEF SUMMARY OF THE INVENTION

This disclosure presents a rotary vane device for hydraulic transmission of rotational mechanical energy on a scale commonly associated with modern hydraulic power systems in industrial and marine service. Primary manipulation of the working fluid is accomplished without the use of reciprocating pistons, valves, or similar mechanical components and the device may function as either a hydraulic pump or hydraulic motor depending only upon the relative direction of flow of the working fluid.

The device primarily consists of a stationary structure for system containment, an internal rotational assembly for energy conversion, and volume compensating valves for protection from excessive pressure fluctuations. Said stationary structure primarily features a containment cylinder with a circular bore installed with diametrically opposed working fluid induction ports and working fluid discharge ports distributed along its axial length and with an end closure structure mechanically secured at each axial end. Said rotational assembly primarily features a rotational shaft, a rotational armature, a set of radial vanes, and one freely rotating radial vane constraint ring installed at each axial end of said armature. Said rotational shaft extends through the axial length of said stationary structure and is simply supported and radially constrained by a low-friction rotational bearing installed in each end closure structure. Said rotational shaft is aligned to rotate on an axis parallel to but radially separate from the bore axis of said containment cylinder. Said rotational shaft is configured to interface with an external rotational power generator or rotational power transmission device. Said rotational armature is concentrically installed on said rotational shaft within said containment cylinder. Said rotational armature features a circular cross-section and is configured as a hollow structural annulus fitted with a structurally integral disk at each axial end. Said rotational armature is diametrically proportioned with an outer diameter of approximately ninety percent of the effective bore of said containment cylinder. A radial vane slot axially proportioned to extend through the axial length of said rotational armature is installed at each of twelve centers uniformly distributed around the periphery of said rotational armature. Said radial vane slot is radially proportioned to extend through the thickness of said structural annulus to preclude efficiency degradation due to radial vane pumping. Said radial vane slot accommodates and annularly constrains one radial vane between linear bearing inserts. Said radial vane is proportioned to extend through the axial length of said rotational armature, radially extend through said structural annulus to approach the bore of said containment cylinder, and permit relative sliding motion within said radial vane slot. A radial vane edge-seal proportioned to make resilient sealing contact with the bore of said containment cylinder is installed on the radially outermost axial edge of said radial vane. A sliding block is installed at each axial end of said radial vane. Said radial vane constraint ring is diametrically proportioned to make a close but sliding fit with the bore of said containment cylinder and is axially and radially constrained by low-friction rotational bearings. Said radial vane constraint ring features an axially extended flange on its outer periphery with said axially extended flange diametrically and axially proportioned to radially constrain said sliding block installed on said radial vane. Said radial vane constraint ring accommodates a concentrically installed axial wear ring and a concentrically installed axial compression spring. Said axial compression spring is proportioned to constrain said axial wear ring to maintain resilient pressure contact with the axial end of said rotating armature. Axially aligned ports with non-return valves installed in the axial face of said wear ring permit high-pressure working fluid to augment the actuation force of said axial compression spring. A high-pressure volume compensation valve and a low-pressure volume compensation valve are installed in said containment cylinder and aligned to preclude the occurrence of hydraulic impacting hydraulic cavitation respectively.

BRIEF DESCRIPTION OF THE DRAWINGS

FIG. 1 also presents section indicators defining the axial locations and projection directions for FIG. 2 and FIG. 3.

FIG. 4 is supported by enlarged scale illustrations of details given in FIG. 4A, FIG. 4B, and FIG. 4C. Section indicators given in FIG. 4 define the axial locations and projection directions for FIG. 5 through FIG. 10.

DETAILED DESCRIPTION OF THE INVENTION

Please note that the device assembly is geometrically symmetrical around the middle of the axial length of the containment structure.

Figure 1:
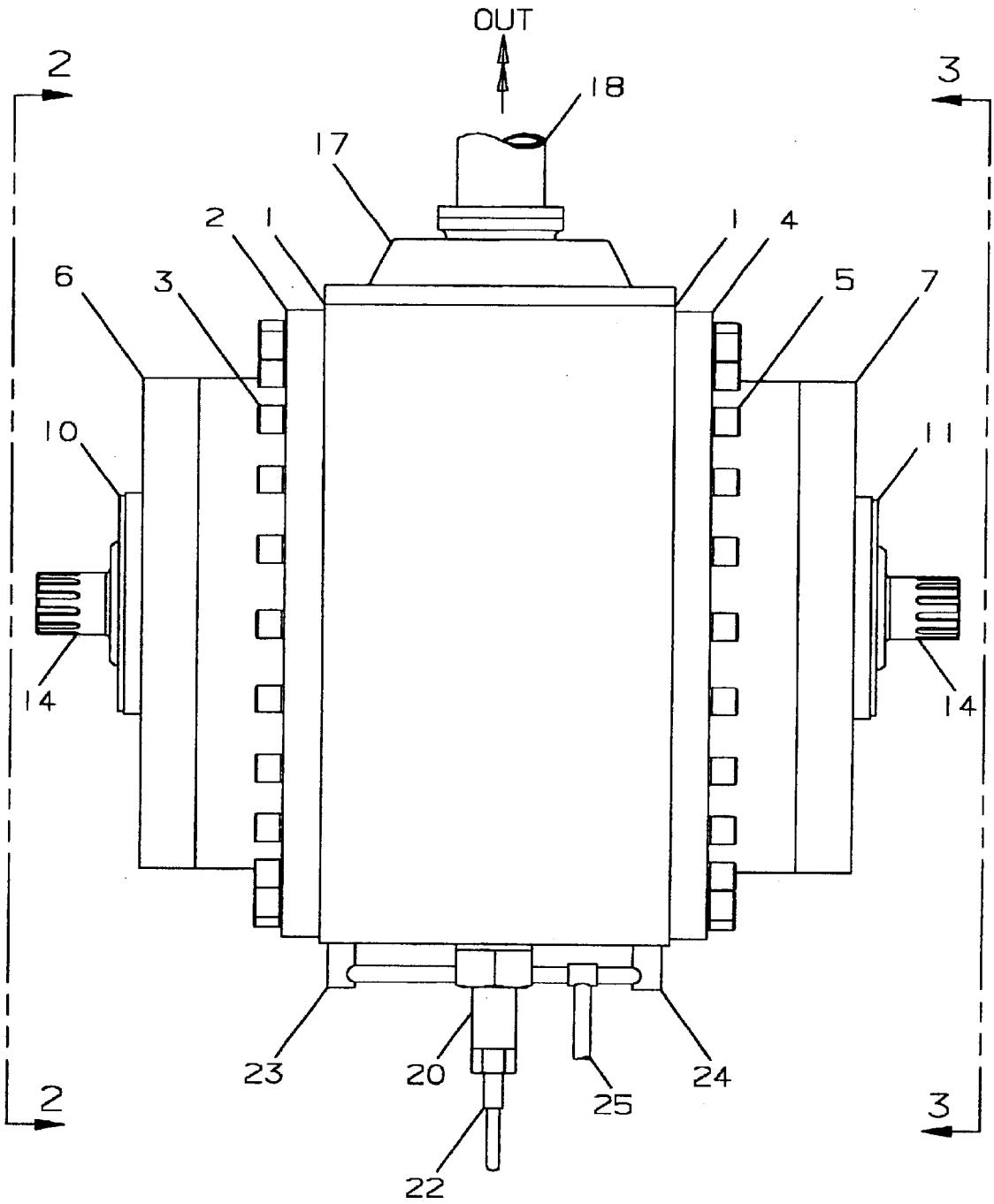
FIG. 1 is a side elevation illustrating the axial disposition of external components.
Figure 2:
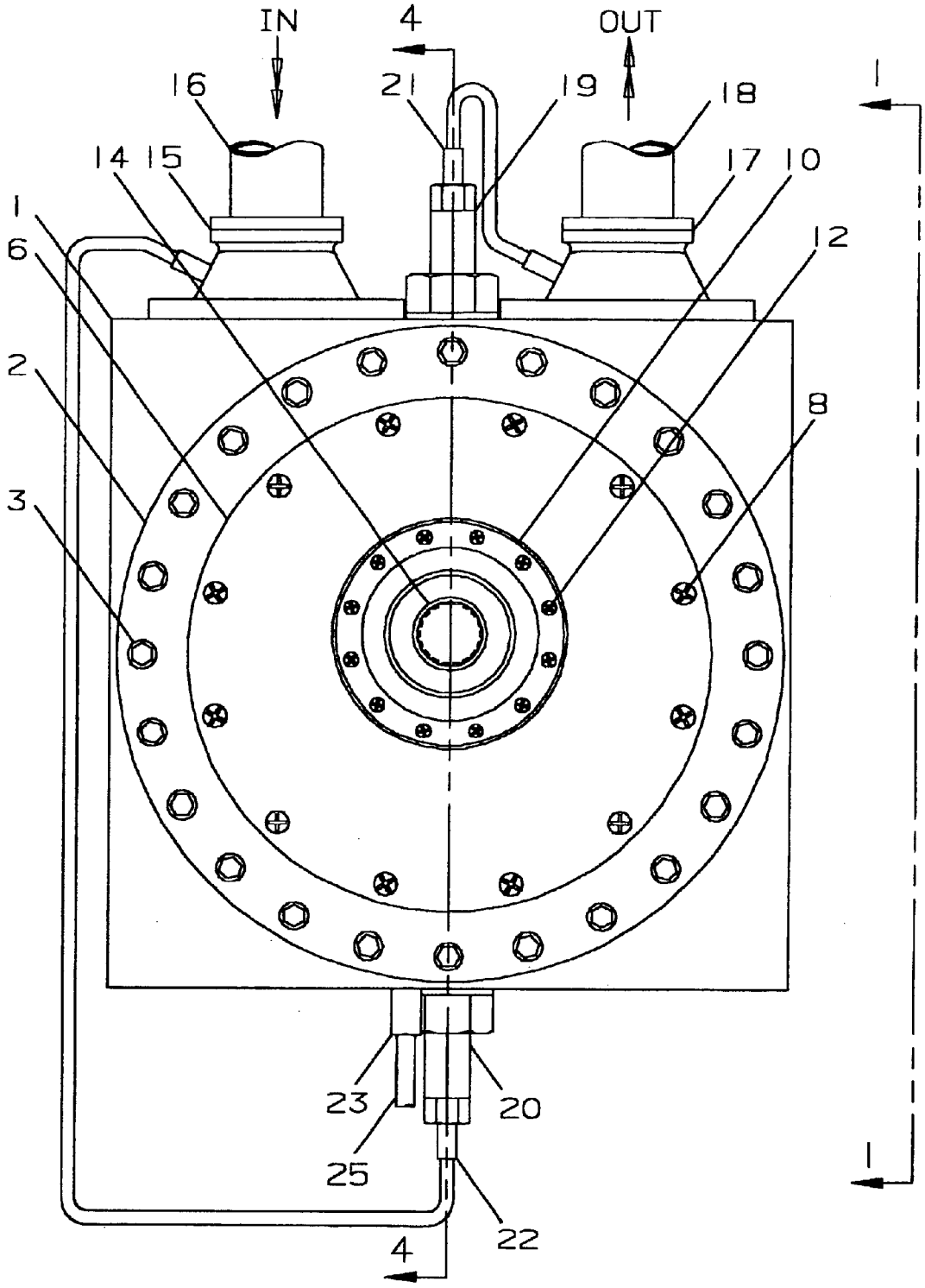
FIG. 2 and FIG. 3 are, respectively, left hand and right hand end elevations from the viewpoints of the section indicators given in FIG. 1 and illustrate the radial disposition of external components.
Figure 3:
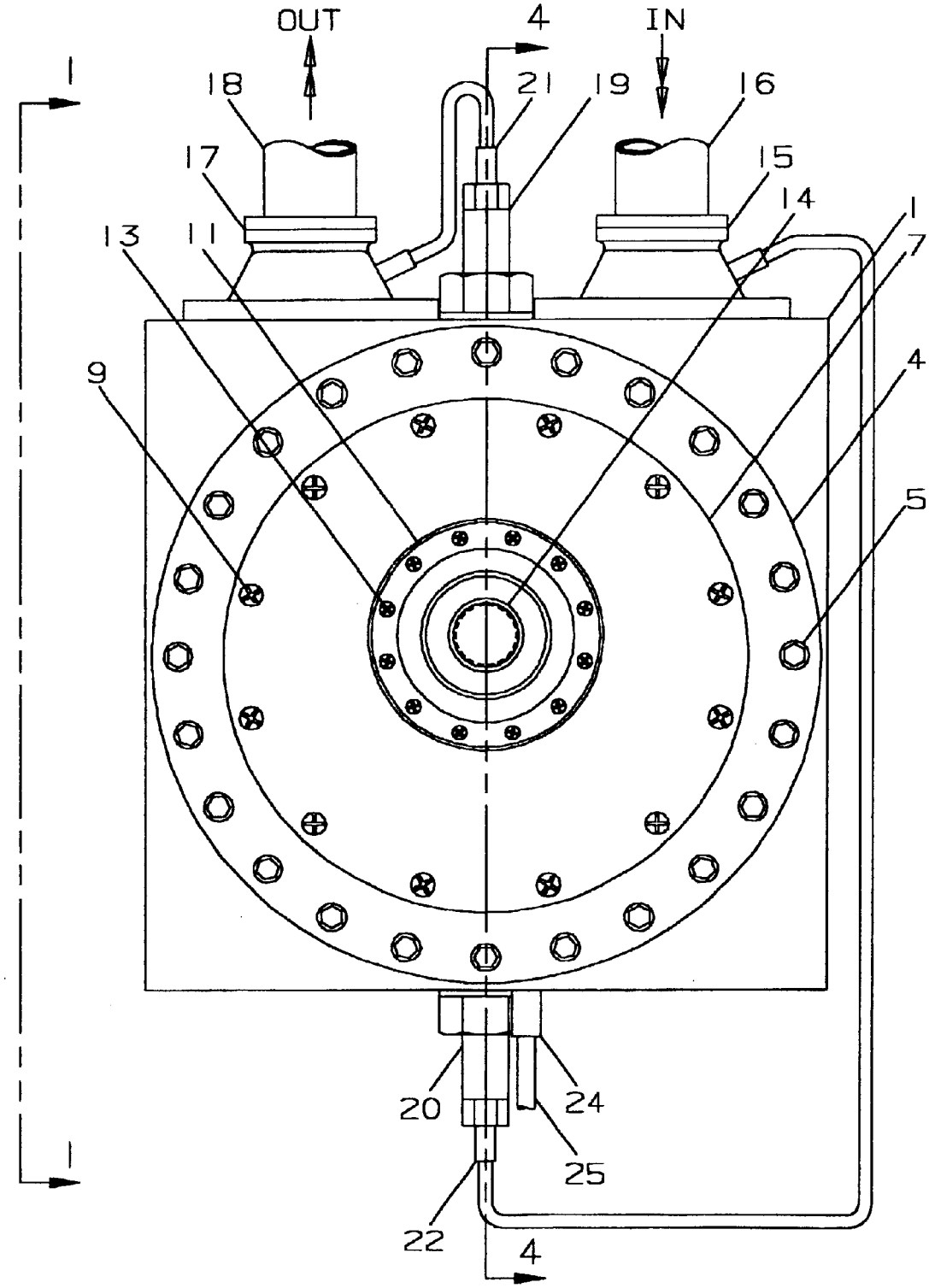
Figure 4:
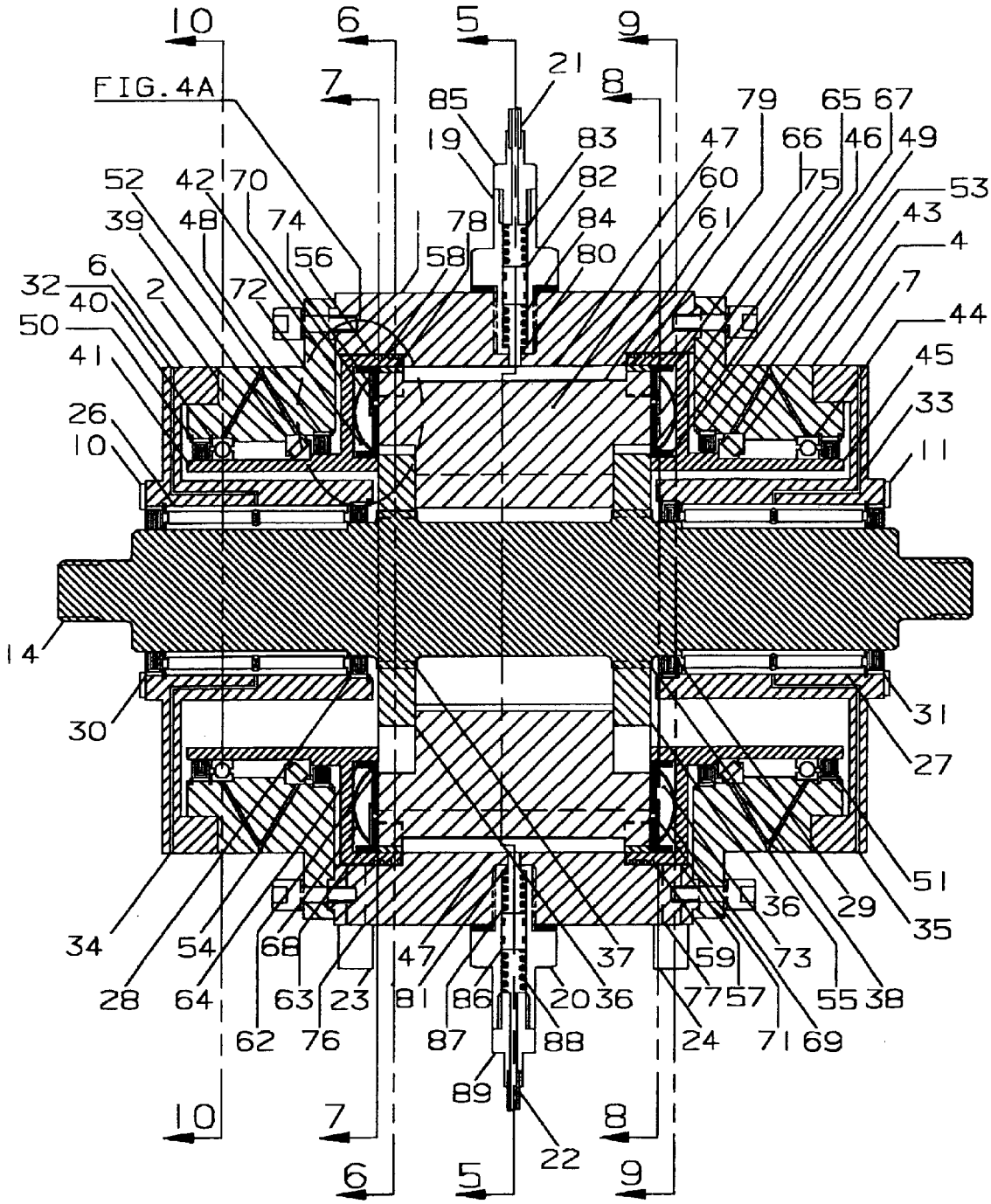
FIG. 4 is a sectional elevation illustrating the internal general assembly along the axis of rotation.
Figure 4B:
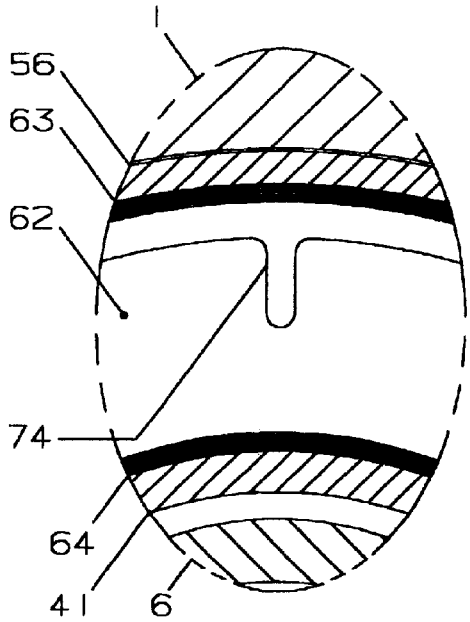
Figure 4A:
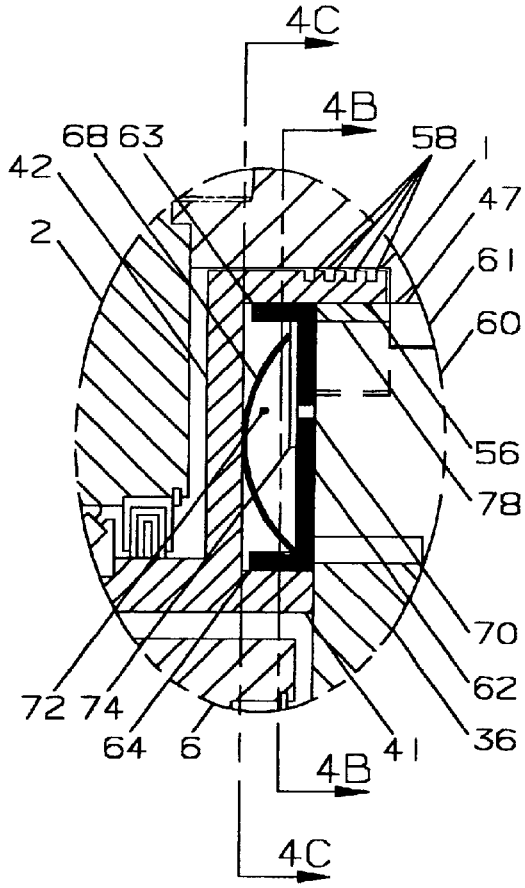
Figure 4C:
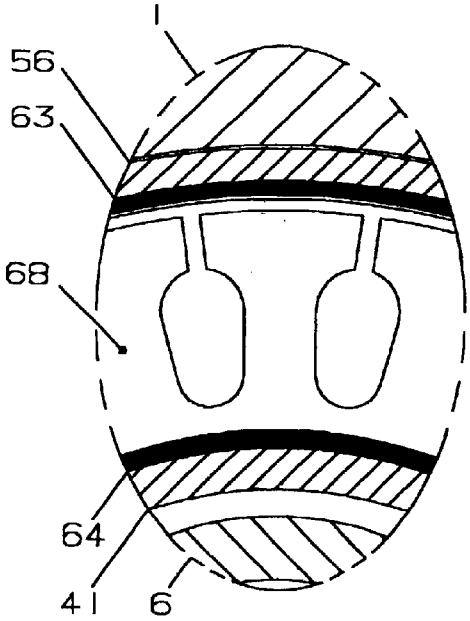

With reference to FIG. 1, FIG. 2, and FIG. 3, containment cylinder 1 and end closure structure 2 are mechanically secured by machine screw 3 installed at each of twenty-four centers. Similarly containment cylinder 1 and end closure structure 4 are mechanically secured by machine screw 5 installed at each of twenty-four centers. Bearing carrier 6 is mechanically secured by machine screw 8 installed at each of twelve centers and bearing carrier 7 is mechanically secured by machine screw 9 installed at each of twelve centers. Machine screw 12 and machine screw 13 each installed at each of twelve centers mechanically secure rotational shaft bearing retainer 10 and rotational shaft bearing retainer 11 respectively. Rotational shaft 14 axially protrudes through rotational shaft seal retainer 10 and rotational shaft seal retainer 11 and the axial ends of rotational shaft 14 are each configured to interface with an external rotational power system appropriate for the intended function. Fluid induction manifold 15 interfaces with fluid supply conduit 16 and working fluid discharge manifold 17 interfaces with working fluid discharge conduit 18. Volume compensation valve 19 and volume compensation valve 20 are mechanically secured to containment cylinder 1 at diametrically opposed locations later discussed. 21 and 22 are conduits for disposal of fractional quantities of working fluid discharged from volume compensation valve 19 and volume compensation valve 20 respectively. Drain sump 23, drain sump 24, and drain manifold 25 are conduits for disposal of fractional quantities of waste working fluid from containment cylinder 1.

With reference to FIG. 4, FIG. 4A, FIG. 4B, and FIG. 4C, rotational shaft 14 extends throughout the length of stationary containment cylinder 1 and passes through end closure structure 2 and end closure structure 4. Low-friction rotational shaft bearing 26 and low-friction rotational shaft bearing 27 radially and axially constrain rotational shaft 14. Bearing seal 28 and bearing seal 29 preclude working fluid contamination of rotational shaft bearing 26 and rotational shaft bearing 27 respectively. Bearing seal 30 and bearing seal 31 preclude lubrication leakage from rotational shaft bearing 26 and rotational shaft bearing 27 respectively. Seal retainer 10 and seal retainer 11 axially secure bearing seal 30 and bearing seal 31 respectively. 32 and 33 are conduits for supply of lubrication media to rotational shaft bearing 26 and rotational shaft bearing 27 respectively. 34 and 35 are conduits for discharge of excess lubrication media from rotational shaft bearing 26 and rotational shaft bearing 27 respectively. Rotational armature 36 is concentrically secured on rotational shaft 14 by spline 37 and spline 38. Low-friction thrust bearing 39 and low friction radial bearing 40 axially and radially constrain axially extended flange 41 integrally installed on the inner periphery of radial vane axial constraint ring 42. Low-friction thrust bearing 43 and low friction radial bearing 44 axially and radially constrain axially extended flange 45 integrally installed on the inner periphery of radial vane axial constraint ring 46. Bearing 39, bearing 40, bearing 43, and bearing 44 are aligned with their rotational axes coincident with the axis of containment cylinder bore 47. Bearing seal 48 and bearing seal 49 preclude working fluid contamination of thrust bearing 39 and thrust bearing 43 respectively. Bearing seal 50 and bearing seal 51 preclude lubrication leakage from radial bearing 40 and radial bearing 44 respectively. 52 is a conduit for supply of lubrication media to bearing 39 and bearing 40 and 53 is a conduit for supply of lubrication media to bearing 43 and bearing 44. 54 is a conduit for discharge of lubrication media from bearing 39 and bearing 40 and 55 is a conduit for discharge of lubrication media from bearing 43 and bearing 44. Radial vane radial constraint ring 56 and radial vane radial constraint ring 57 each consist of an axially extended flange integrally installed on the outer periphery of radial vane axial constraint ring 42 and the outer periphery of radial vane axial constraint ring 46 respectively. Radial vane radial constraint ring 56 and radial vane radial constraint ring 57 are each diametrically proportioned to maintain a sliding fit with the containment cylinder bore 47. Four axially spaced circumferential channels 58 and four axially spaced circumferential channels 59 are installed in the outer periphery of radial vane radial constraint ring 56 and radial vane radial constraint ring 57 respectively. Radial vane 60 is radially constrained by radial vane radial constraint ring 56 at one axial end and radial vane radial constraint ring 57 at the other. Radial vane edge seal 61 is installed on the outermost peripheral edge of radial vane 60. Wear ring 62 is diametrically proportioned to maintain a constrained sliding fit between the radially outermost surface of axially extended flange 41 and the radially innermost surface of radial vane radial constraint ring 56. Wear ring 65 is diametrically proportioned to maintain a constrained sliding fit between the radially outermost surface of axially extended flange 45 and the radially innermost surface of radial vane radial constraint ring 57. Wear ring 62 is installed with structurally integral, axially extended flange 63 on its outer periphery and structurally integral, axially extended flange 64 on its inner periphery. Wear ring 65 is installed with structurally integral, axially extended flange 66 on its outer periphery and structurally integral, axially extended flange 67 on its inner periphery. Axial compression spring 68 and axial compression spring 69 are proportioned to induce, respectively, wear ring 62 and wear ring 65 to maintain resilient axial contact with rotational armature 36. Working fluid transfer port 70 and working fluid transfer port 71 allow movement of pressurized working fluid to axial compression spring chamber 72 and axial compression spring chamber 73 respectively. Non-return reed valve 74 and non-return reed valve 75 preclude movement of pressurized working fluid from axial compression spring chamber 72 and axial compression spring chamber 73 respectively. 76 and 77 are conduits for discharge of leaked working fluid from containment cylinder 1 to waste working fluid drain sump 23 and working fluid drain sump 24 respectively. Sliding block 78 and sliding block 79 are proportioned to distribute the centripetal force induced by rotation of radial vane 60 over appropriate areas of radial vane radial constraint ring 56 and radial vane radial constraint ring 57 respectively. Volume compensation valve 19 and volume compensation valve 20 extend partially through and are mechanically secured to containment cylinder 1. 80 and 81 are conduits for movement of working fluid to volume compensation valve 19 and volume compensation valve 20 respectively. Within volume compensation valve 19 sliding piston 82 is resiliently constrained between outer axial compression spring 83 and inner axial compression spring 84. Outer axial compression spring 83 is proportioned to permit radially outward movement of sliding piston 82 in reaction to working fluid pressure pulses with a high-pressure threshold in excess of prescribed maximum system pressure and frequency equal to radial vane passage frequency. Inner axial compression spring 84 is proportioned to decelerate sliding piston 82 when returning to its rest location. Threaded core 85 is proportioned to axially secure outer axial compression spring 83 and compresses outer axial compression spring 83 and inner axial compression spring 84 to obtain appropriate valve activation parameters. 21 is a conduit for return of leakage working fluid to the working fluid discharge manifold. Within volume compensation valve 20 sliding piston 86 is resiliently constrained between inner axial compression spring 87 and outer axial compression spring 88. Inner axial compression spring 87 is proportioned to permit radially inward movement of sliding piston 86 in reaction to working fluid pressure pulses with a low-pressure threshold less than prescribed minimum system pressure and a frequency equal to radial vane passage frequency. Outer axial compression spring 88 is proportioned to decelerate sliding piston 86 when returning to its rest location. Threaded core 89 axially secures outer axial compression spring 88 and compresses outer axial compression spring 88 and inner axial compression spring 87 to obtain appropriate valve activation parameters. 22 is a conduit for return of leakage working fluid to the working fluid supply manifold.

Figure 5:
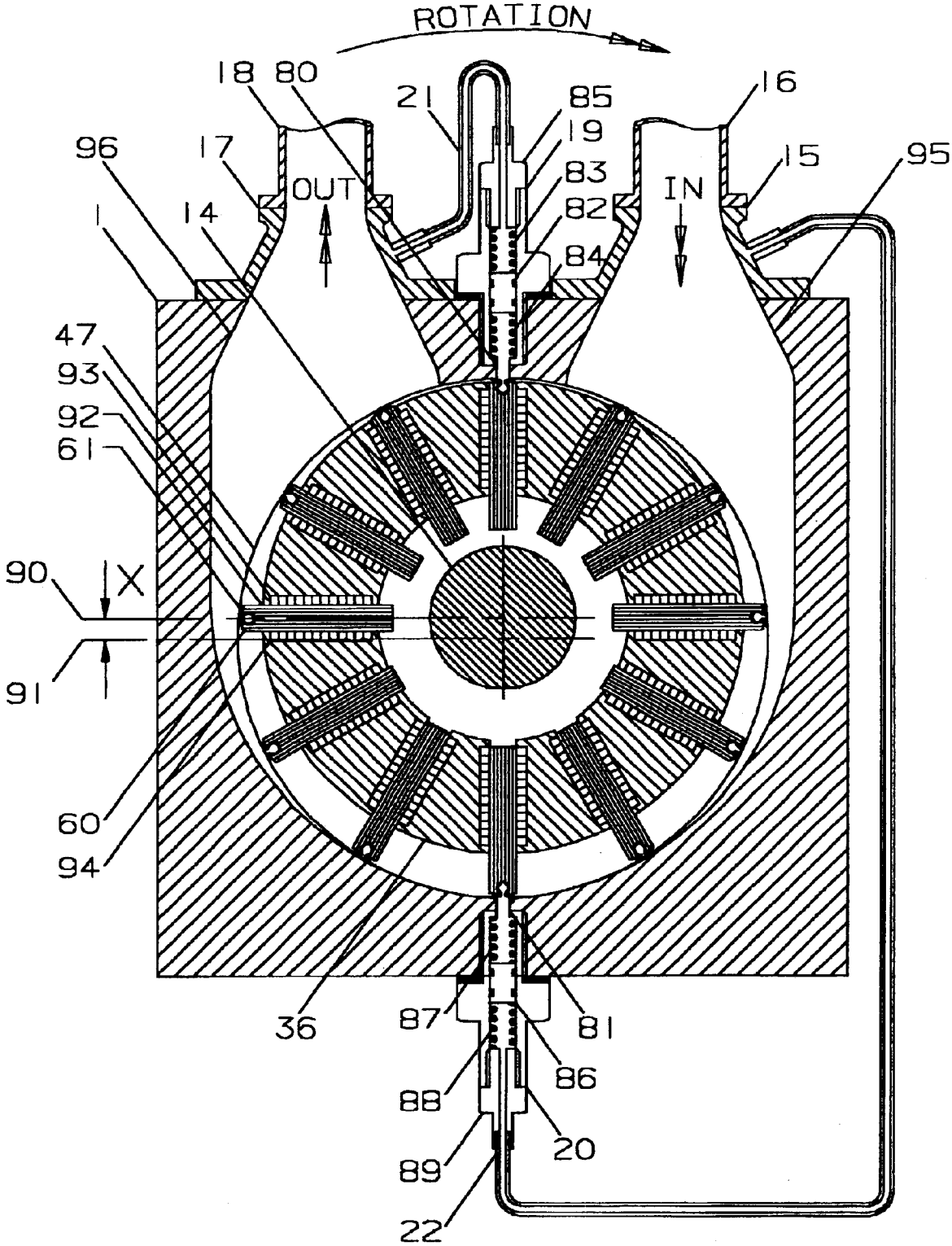
FIG. 5 is a cross section at mid-length of the containment cylinder and illustrates the radial arrangement of working fluid induction ports, working fluid discharge ports, and other functionally significant components.

With reference to FIG. 5, the vertical plane of the rotational axis of rotational shaft 14 is horizontally coincident with the vertical plane of the longitudinal axis of containment cylinder bore 47. The horizontal plane 90 of the rotational axis of rotational shaft 14 is separated from the horizontal plane 91 of the axis of the containment cylinder bore 47 by radial distance "X". Rotational armature 36 is circular in cross-section and is installed with one axially aligned radial vane slot 92 at each of twelve equidistantly spaced centers around its periphery. Radial vane slot 92 is configured and proportioned to closely constrain one linear bearing segment 93 in the side of said slot oriented in the direction of rotation and closely constrain one linear bearing segment 94 in the side of said slot opposite to the direction of rotation. Linear bearing segment 93 and linear bearing segment 94 are preferably constructed from hard graphite, ceramic or other wear resistant, low friction, bearing material. Radial vane 60 is proportioned to make a closely constrained sliding fit between the opposing faces of linear bearing segment 93 and linear bearing segment 94 and is radially constrained to maintain a relatively small distance between its radially outermost edge and the bore 47 of stationary containment cylinder 1 at all rotational positions. One vane edge seal 61 is installed on the outer axial edge of radial vane 60 to resiliently close the gap between radial vane 60 and stationary containment bore 47. Working fluid induction port 95 and working fluid discharge port 96 are interfaced with working fluid supply manifold 15 and with working fluid discharge manifold 17 respectively. 16 and 18 are terminations of the external working fluid distribution system. Volume compensation valve 19 is installed in containment cylinder 1 on the radian at which the peripheral surface of rotational armature 36 is least distant from containment cylinder bore 47. Volume compensation valve 20 is installed in containment cylinder 1 on the radian at which the peripheral surface of rotational armature 36 is most distant from containment cylinder bore 47. Internal details of volume compensation valve 19 and volume compensation valve 20 were previously discussed.

Figure 6:
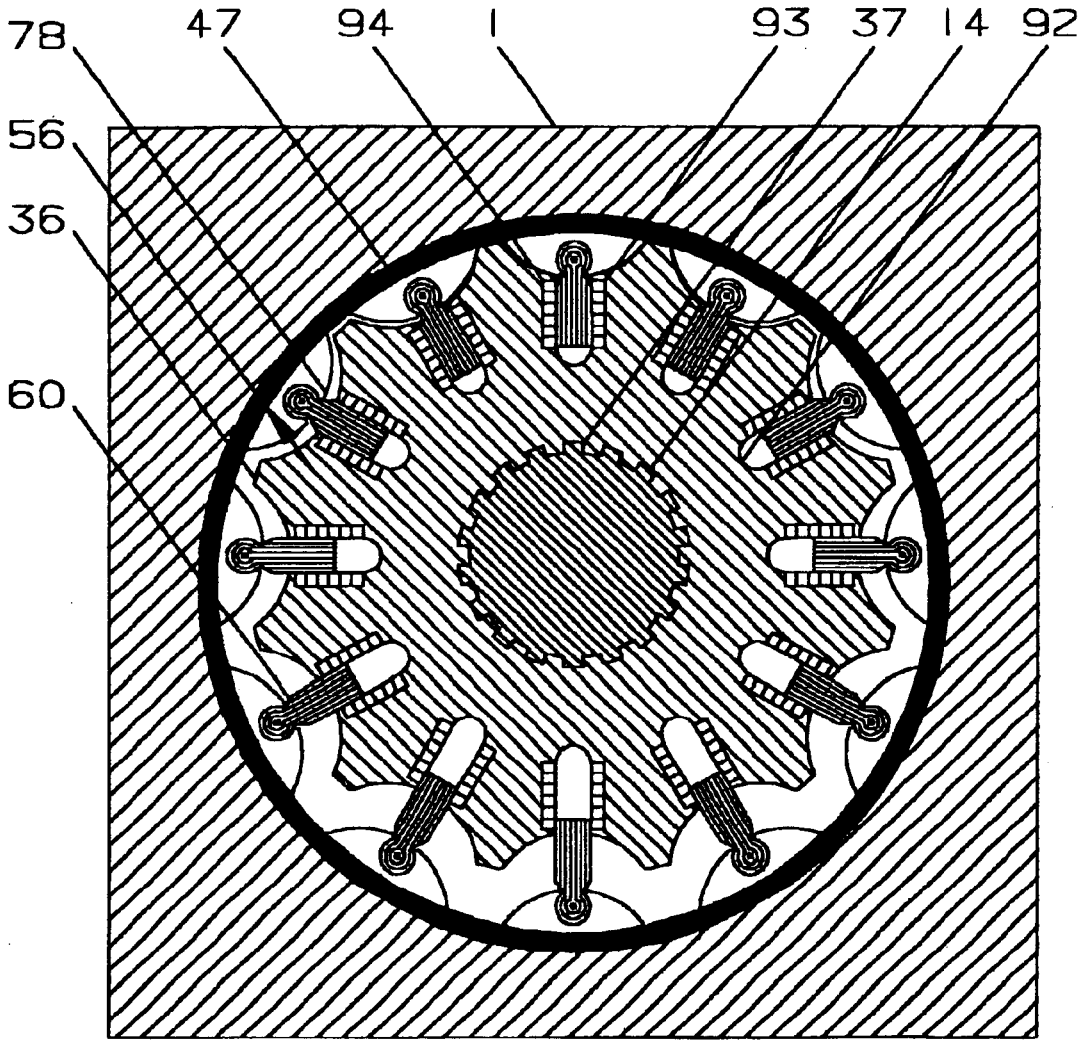
FIG. 6 is a cross section close to the axial end of the rotational armature and illustrates arrangements for radial vane end constraint.

With reference to FIG. 6, rotational armature 36 is integrally secured to rotating shaft 14 by closely fitted mechanical spline 37. One sliding block 78 attached to radial vane 60 maintains uniform sliding contact with the radially innermost surface of radial vane radial constraint ring 56. Radial vane 60 is constrained between the opposing faces of linear bearing segment 93 and linear bearing segment 94.

Figure 7:
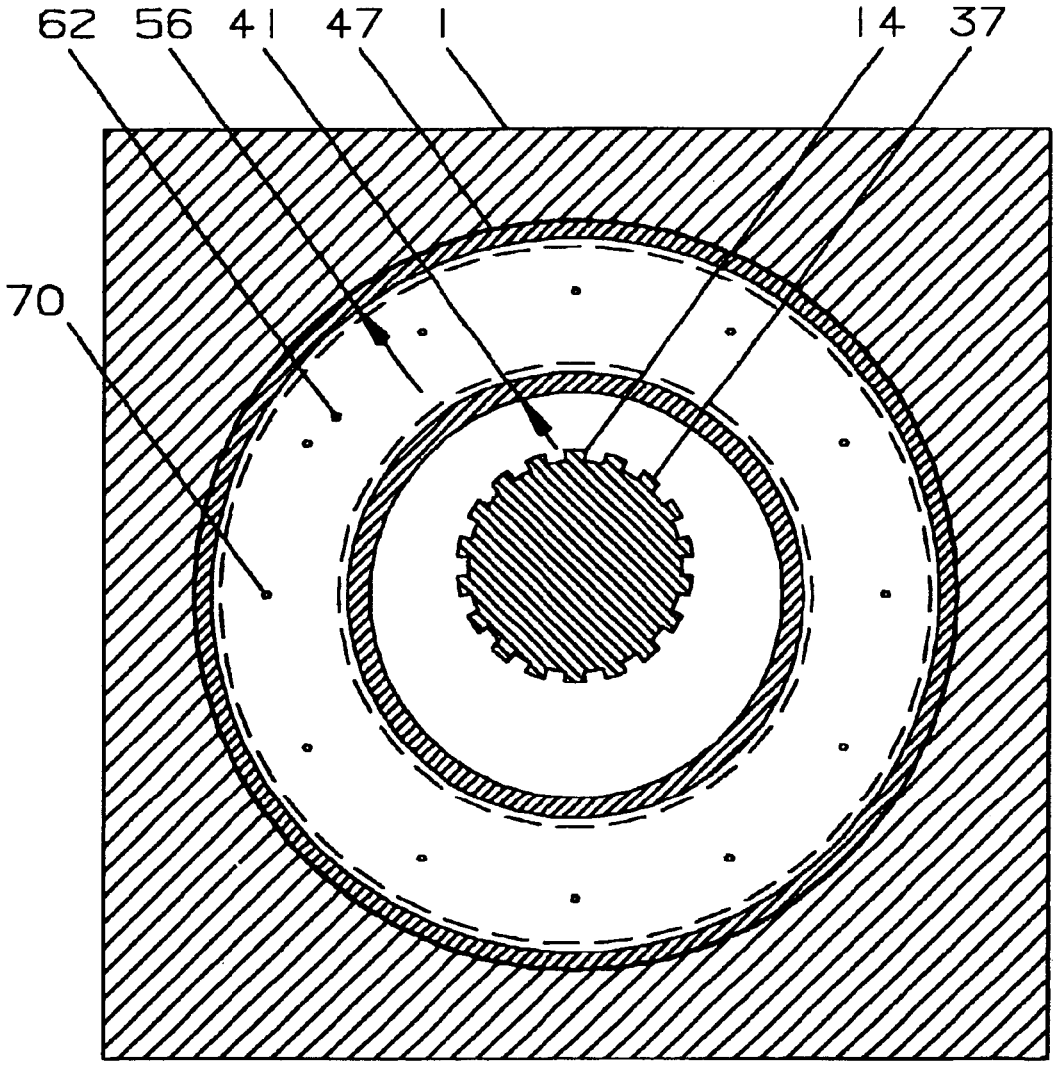
FIG. 7 is a cross section at the axially innermost face of one wear ring and primarily illustrates the radial arrangement at the axial interface of the radial vane end constraint assembly.

With reference to FIG. 7, the outer diameter of radial vane radial constraint ring 56 is proportioned to maintain a sliding fit with containment cylinder bore 47. Wear ring 62 is proportioned to maintain a closely constrained but sliding fit with the inner periphery of radial vane radial constraint ring 56 and the outer surface of axially extended flange 41. The axial face of wear ring 62 accommodates a working fluid transfer port 70 installed on each of twelve equally spaced radian centers.

Figure 8:
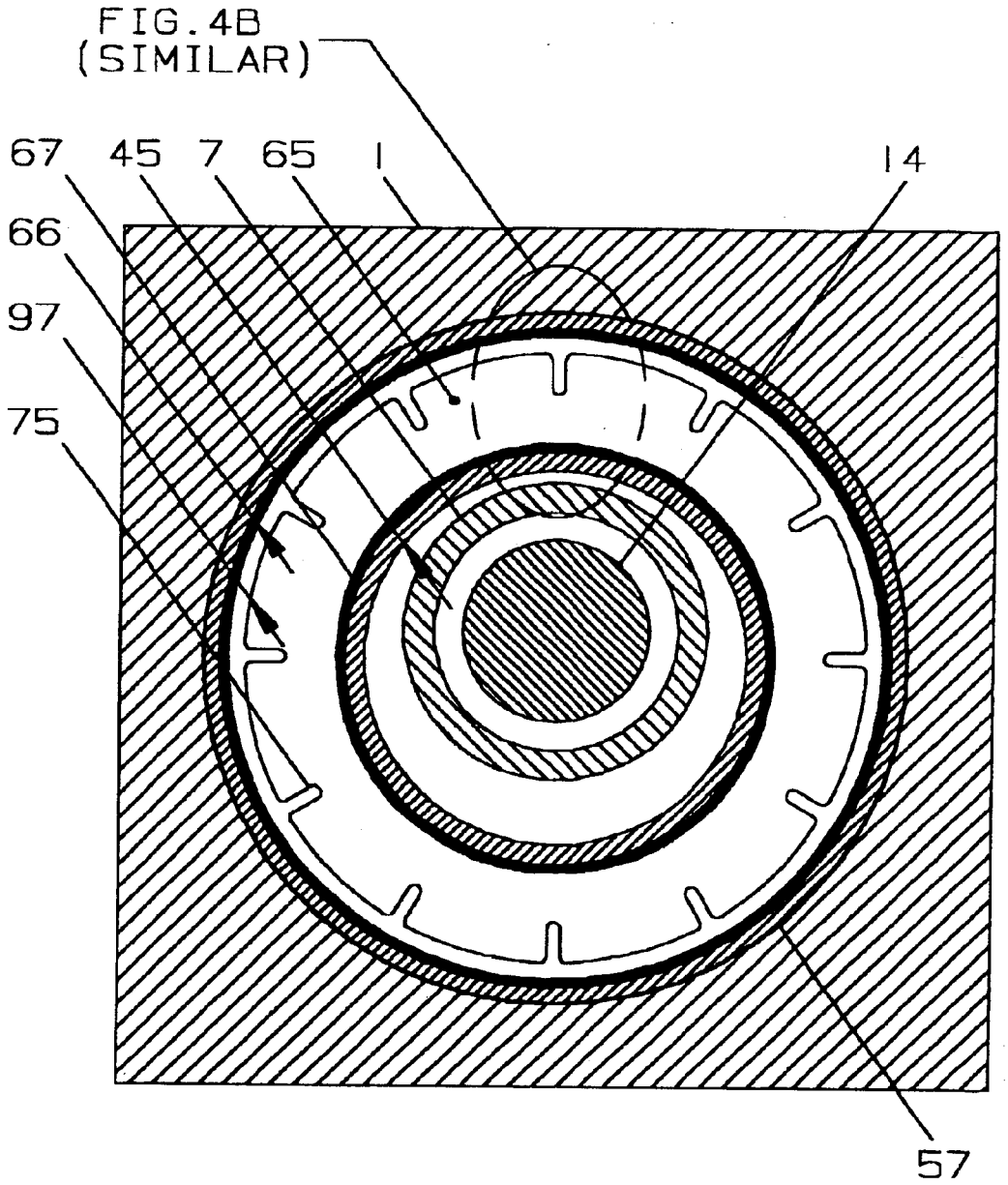
FIG. 8 is a cross section at the axially outermost face of one wear ring and primarily illustrates the non-return reed-valve installation.

With reference to FIG. 8, wear ring flange 66 is diametrically proportioned to maintain a constrained sliding fit with the inner peripheral surface of radial vane radial constraint ring 57 and wear ring flange 67 is diametrically proportioned to maintain a constrained sliding fit with the outer peripheral surface of radial vane constraint ring flange 45. Non-return reed valve 75 is a thin flat-spring radial projection installed at each of twenty-four equidistantly spaced radial centers around the inner periphery of reed valve ring 97. Non-return reed valve 75 is radially proportioned and aligned to cover one working fluid transfer port 71 discussed in the previous paragraph. Reed valve ring 97 is diametrically proportioned to maintain a constrained fit with the inner axial surface of wear ring peripheral flange 66.

Figure 9:
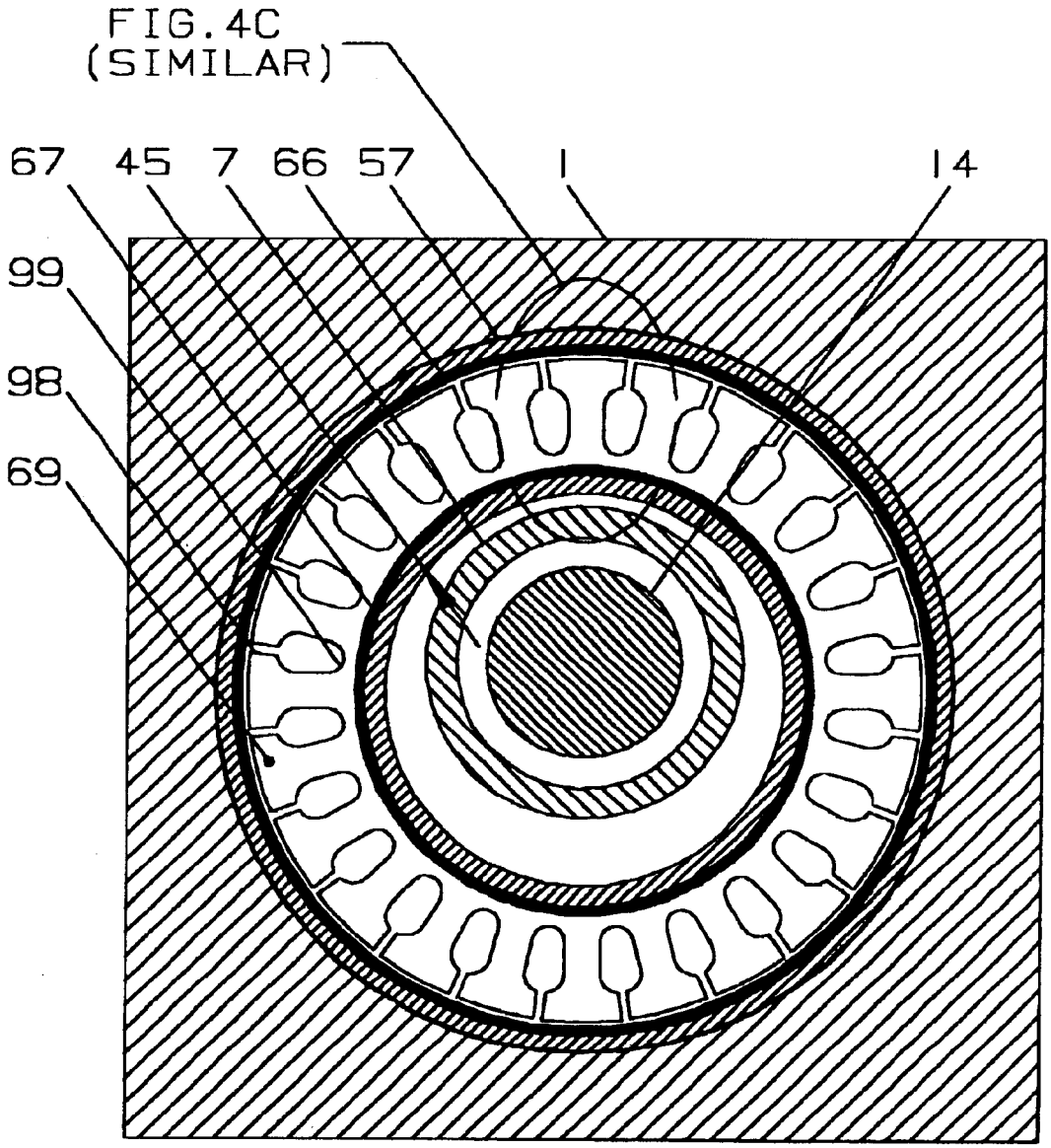
FIG. 9 is a cross section at the axially innermost face of one radial constraint ring and illustrates the arrangement and geometry of the axial compression spring.

With reference to FIG. 9, axial compression spring 69 is a quasi-flat ring with an inner diameter proportioned to maintain a constrained sliding fit with wear ring peripheral flange 67. The outer diameter of annular axial compression spring 69 is proportioned to maintain a small distance of separation from the inside surface of wear ring outer peripheral flange 66. Axial compression spring 69 features an integral but semi-independent radial spring segment 98 installed at each of twenty-four equidistantly spaced radial centers around a common root ring 99. Material thickness and axial shaping of annular axial compression spring 69 are proportioned to fulfill spring rate and axial extension requirements as specifically appropriate for intended service. For the purpose of this disclosure annular axial compression spring 69 is illustrated as a single entity however an assembly consisting of a multiplicity of annular axial compression spring entities may be selected as necessary to fulfill particular service requirements. Arrangements of other illustrated components were discussed in prior paragraphs.

Figure 10:
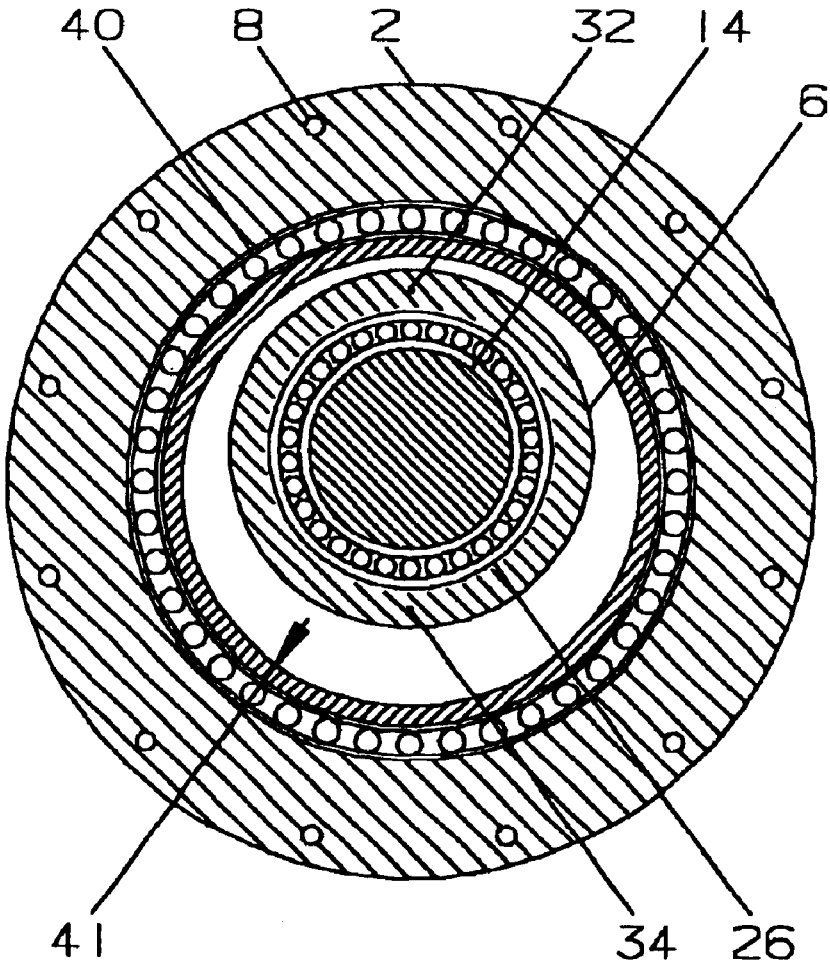
FIG. 10 is a cross section through the mid-length of one rotational bearing assembly and illustrates arrangements for radial constraint of primary rotational components.
Figure 11:
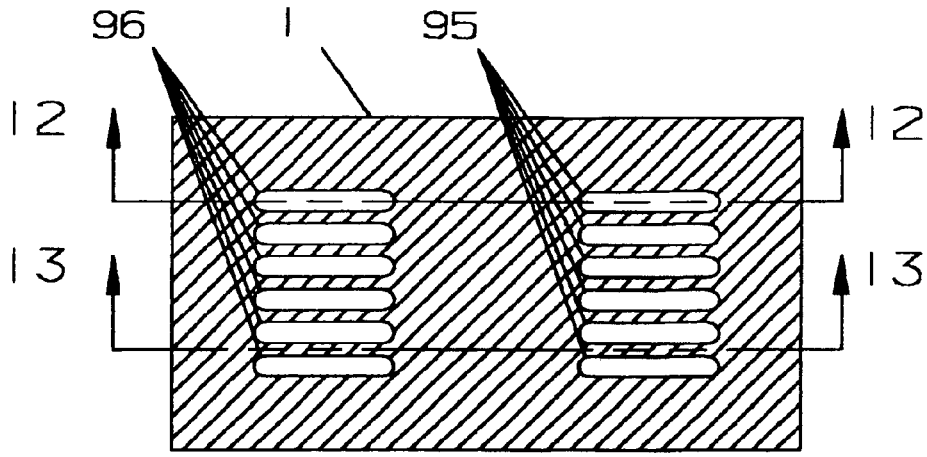
FIG. 11 is a horizontal elevation and illustrates the axial arrangement of working fluid induction ports and working fluid discharge ports at the external interface of the containment cylinder.
Figure 12:
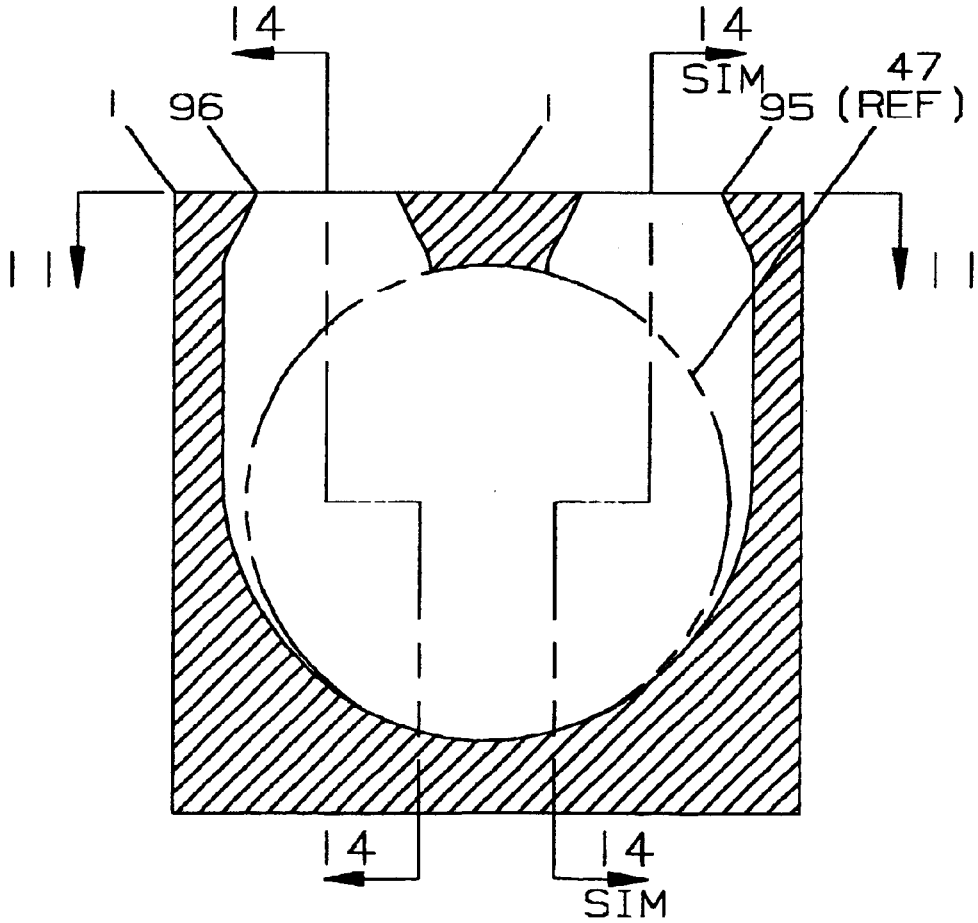
FIG. 12 is a cross section through the stationary containment cylinder and illustrates the radial arrangement and geometry of working fluid induction ports and working fluid discharge ports.
Figure 13:
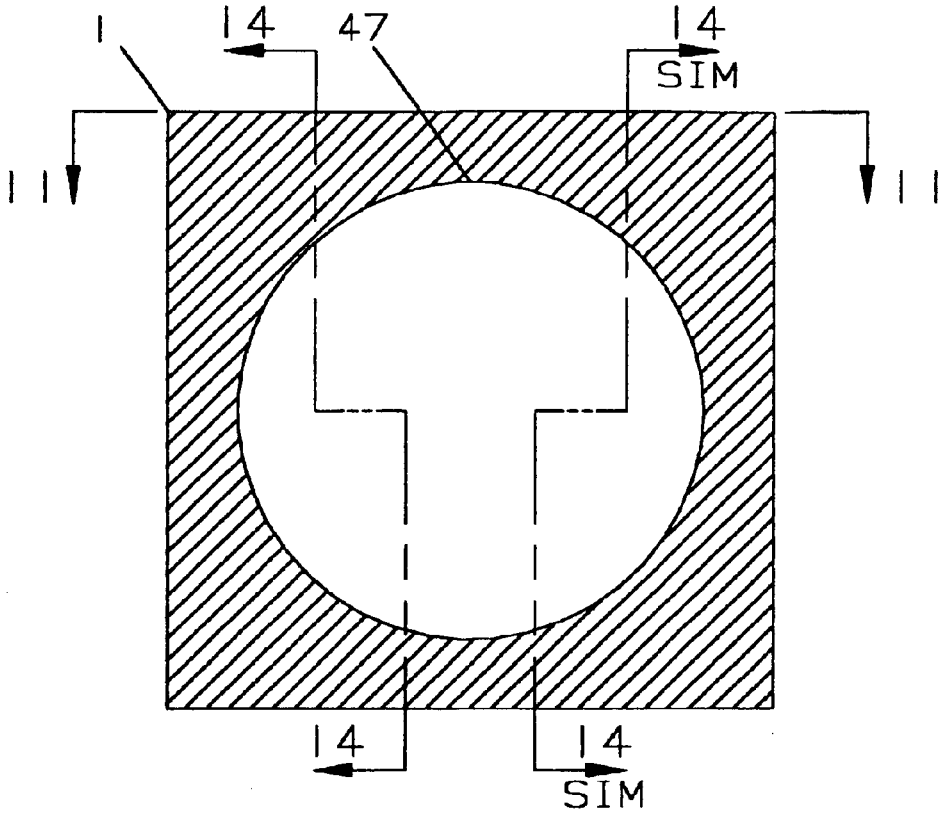
FIG. 13 is a cross section through the stationary containment cylinder and illustrates the continuity of containment structure between working fluid induction ports and working fluid discharge ports.
Figure 14:
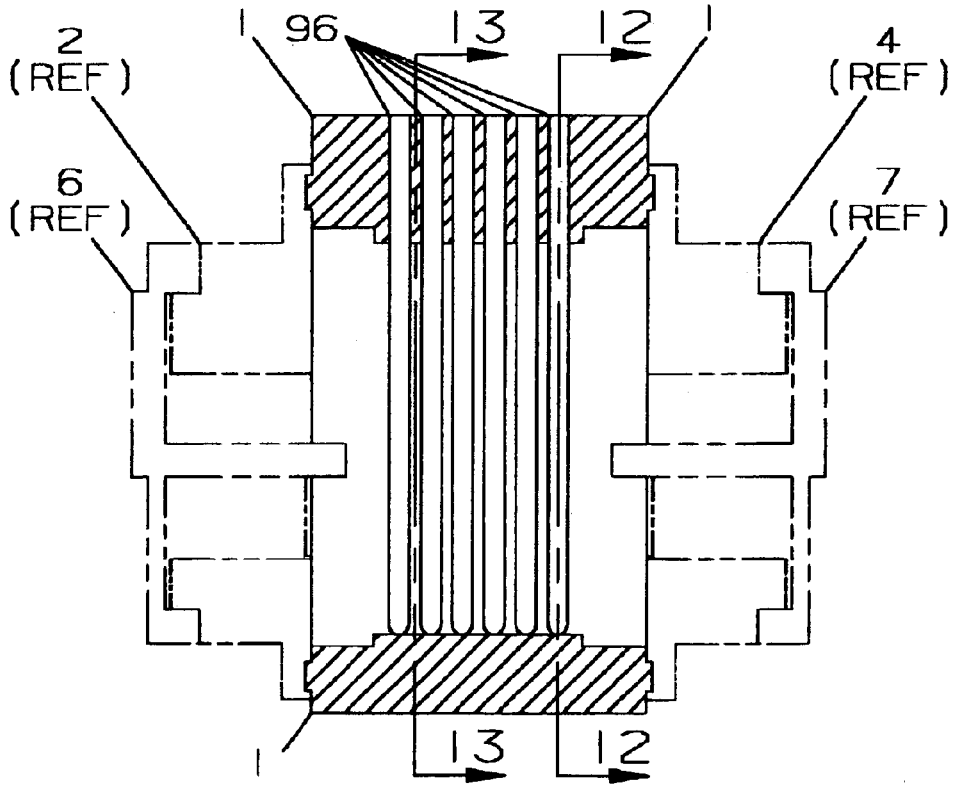
FIG. 14 is a sectional elevation through the stationary containment cylinder and illustrates the axial distribution of working fluid induction ports and working fluid discharge ports.

With reference to FIG. 10, rotational shaft bearing 26 installed in bearing carrier 6 radially supports rotational shaft 14. Rotational bearing 40 installed in end closure structure 2 radially supports rim flange 41. 32 and 34 are conduits for supply of lubricant to bearing 26 and discharge of excess lubricant from bearing 26 respectively.

With reference to FIG. 11, FIG. 12, FIG. 13, and FIG. 14, working fluid induction port 95 and working fluid discharge port 96 are opposite handed but geometrically similar and each consists of an elongated opening penetrating the wall of containment cylinder 1. For the purpose of this disclosure one working fluid induction port 95 and one working fluid discharge port 96 are installed at each of six centers distributed along the axial length of containment cylinder 1.

Figure 15:
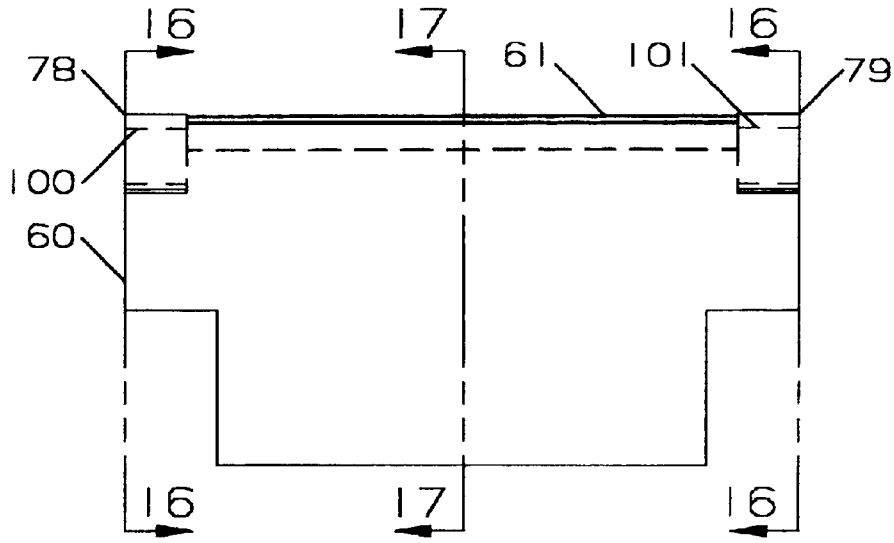
FIG. 15 is a sectional elevation of one radial vane and illustrates the significant geometric and assembly details of said radial vane and directly associated components. Section indicators given in FIG. 15 define the axial locations and projection directions for FIG. 16 and FIG. 17.

With reference to FIG. 15, radial vane 60 primarily consists of a flat panel structure. Sliding block 78 is secured on one radially outermost axial end of radial vane 60 and sliding block 79 secured at the other radially outermost axial end of radial vane 60. Radial vane edge seal 61 is secured along the radially outermost axial edge of radial vane 60.

Figure 16:
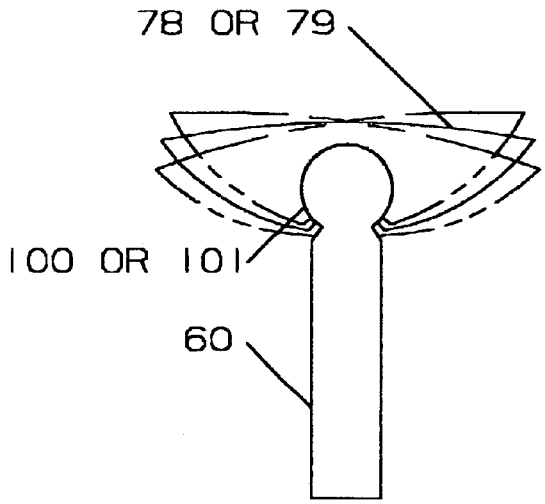
FIG. 16 is an elevation at the axial end of one radial vane and illustrates radial vane end geometry and interface details.

With reference to FIG. 16, sliding block 78 and sliding block 79 are secured to radial vane 60 by closely fitted rotational bearing interface 100 and closely fitted rotational bearing interface 101 respectively. Rotational bearing interface 100 and rotational bearing interface 101 are proportioned to allow only partial rotation of the attached sliding block relative to radial vane 60.

Figure 17:
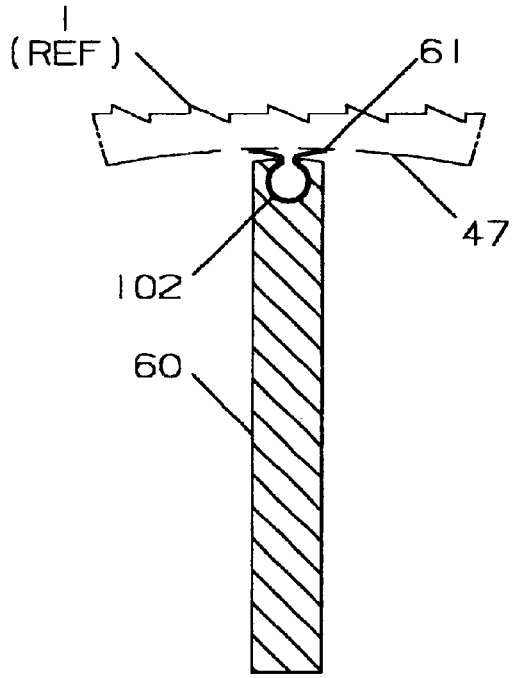
FIG. 17 is a section through one radial vane and its associated radial vane-edge seal and illustrates the installation interfaces and construction details of one radial vane-edge seal.

With reference to FIG. 17, radial vane edge seal 61 is, essentially, a relatively thin cylindrical spring structure. One radial vane edge seal 61 is installed on the radially outermost edge of radial vane 60 by a closely fitted rotational bearing interface 102. Rotational bearing interface 102 is proportioned to allow only partial rotation of radial vane edge seal 61 relative to radial vane 60. The radially outermost side of radial vane edge seal 61 is axially bifurcated and proportioned to allow both edges of said axial bifurcation to maintain resilient sliding contact with containment cylinder bore 47.

I claim as my invention:

1. A rotary vane machine for the interrelated manipulation of hydraulic and mechanical energy and comprising:

a stationary containment structure consisting of a containment cylinder with circular bore installed with a closure structure at each end and with ports radially and axially oriented and proportioned for optimal induction and optimal discharge of throughput working fluid;

a volume compensation valve installed in aforesaid stationary containment cylinder, positioned and proportioned to optimally control the magnitude of function related high-pressure fluctuations in contained working fluid;

a volume compensation valve installed in aforesaid stationary containment cylinder, positioned and proportioned to optimally control the magnitude of function related low-pressure fluctuations in contained working fluid;

a rotational shaft installed within aforesaid stationary containment structure proportioned to extend through the axial length of aforesaid stationary closure structure with one or both ends configured to interface with an external rotational power system;

a rotational armature coaxially secured on aforesaid rotational shaft within aforesaid containment cylinder and configured as a structural annulus with a circular cross-section diametrically proportioned to equal approximately ninety percent of the bore of said containment cylinder;

a radial vane slot installed at each of twelve axially aligned centers uniformly distributed around the outer periphery of aforesaid rotational armature and proportioned to extend through its axial length and through the radial thickness of its structural annulus;

a radial vane support linear bearing insert slot installed in each face of aforesaid radial vane slot and proportioned to extend through is axial length and partially through its radial width;

a radial vane support linear bearing insert installed within aforesaid radial vane support linear bearing insert slot and proportioned to extend through its axial length and its radial width;

a radial vane installed in each aforesaid radial vane slot and proportioned to make a constrained sliding fit with the facing surface of aforesaid support linear bearing insert, axially extend through the axial length of aforesaid rotational armature, and radially extend through the radial thickness of its structural annulus;

a radial vane edge seal individually installed on the radially outermost axial edge of aforesaid radial vane and proportioned to maintain resilient sealing contact with the bore of the aforesaid containment cylinder;

a radial vane sliding-block installed on each peripherally outermost axial end of aforesaid radial vane and secured by a closely fitted rotational bearing proportioned to allow partial relative rotation;

a low-friction rotational bearing installed in each aforesaid end closure structure with said low-friction bearing proportioned to radially constrain aforesaid rotational shaft and aligned with its rotational axis parallel to but radially displaced from the bore axis of aforesaid containment cylinder;

a radial vane axial constraint ring installed at each axial end of aforesaid rotational armature and configured to feature an axially extended flange on its outer periphery and an axially extended flange its inner periphery;

a low friction rotational bearing secured in each aforesaid end closure structure with said low-friction bearing proportioned to radially and axially constrain aforesaid radial vane axial constraint ring and aligned with its rotational axis concentric with the bore axis of aforesaid containment cylinder;

a radial vane radial vane radial constraint ring configured as an integral axial extension of the aforesaid outer peripheral flange of aforesaid radial vane axial constraint ring and oriented and proportioned to radially constrain aforesaid sliding block;

a wear-ring installed on the axially innermost face of aforesaid radial vane axial constraint ring and proportioned to maintain a radially constrained sliding fit with the facing surfaces of the inner and outer peripheral flanges of aforesaid radial vane axial constraint ring;

an axially oriented working fluid transfer port installed at each of several concentric centers around the axial face of aforesaid wear ring;

a non-return reed valve installed at each of several concentric centers on the axially outermost axial face of aforesaid wear ring and coaxially aligned with the aforesaid working fluid transfer port;

an axial compression spring installed on the axially outermost face of each aforesaid wear ring and axially proportioned to maintain resilient axial bearing contact of the axially innermost axial face aforesaid wear ring with the axial end of aforesaid rotating armature.

* * * * *